United States Patent [19]

Cook et al.

[11] Patent Number: 4,493,773

[45] Date of Patent: Jan. 15, 1985

[54] LOW PHOSPHATE, SOFTENING LAUNDRY DETERGENT CONTAINING ETHOXYLATED NONIONIC, ALKYLPOLYSACCHARIDE AND CATIONIC SURFACTANTS

[75] Inventors: Thomas E. Cook; Ernest W. Dolle, both of Cincinnati, Ohio

[73] Assignee: The Procter & Gamble Company, Cincinnati, Ohio

[21] Appl. No.: 574,633

[22] Filed: Jan. 27, 1984

Related U.S. Application Data

[63] Continuation of Ser. No. 376,877, May 10, 1982, abandoned.

[51] Int. Cl.[3] ..... C11D 1/62; C11D 1/835; D06M 13/18; D06M 13/46

[52] U.S. Cl. ..... 252/8.8; 252/8.9; 252/153; 252/173; 252/174.17; 252/174.21; 252/174.22; 252/528; 252/547; 252/DIG. 1; 252/DIG. 14

[58] Field of Search ..... 252/8.8, 8.9, 110, 89.1, 252/173, 174.17, 174.21, 528, 547

[56] References Cited

U.S. PATENT DOCUMENTS

| | | | |
|---|---|---|---|
| B 458,819 | 4/1976 | Weber | 252/545 |
| 2,049,758 | 8/1936 | Bertsch et al. | 260/210 |
| 2,390,507 | 12/1945 | Cantor | 260/210 |
| 2,671,780 | 3/1954 | Gaver et al. | 260/233.3 |
| 2,671,781 | 3/1954 | Gaver et al. | 260/234 |
| 2,950,253 | 8/1960 | Kling et al. | 252/547 |
| 2,959,500 | 11/1960 | Schlapfer et al. | 127/37 |
| 2,974,134 | 3/1961 | Pollitzer | 260/209 |
| 2,995,523 | 8/1961 | Germann | 252/528 |
| 3,092,618 | 6/1963 | Rosen et al. | 260/209 |
| 3,219,656 | 11/1965 | Boettner | 260/210 |
| 3,222,213 | 12/1965 | Clark | 117/119.6 |
| 3,314,936 | 4/1967 | Ames | 260/209 |
| 3,322,676 | 5/1967 | Hiestand | 252/542 |
| 3,346,558 | 10/1967 | Roth | 260/210 |
| 3,351,483 | 11/1967 | Miner et al. | 117/66 |
| 3,360,470 | 12/1967 | Wixon | 252/99 |
| 3,450,690 | 6/1969 | Gibbons et al. | 260/210 |
| 3,539,520 | 11/1970 | Cantor et al. | 252/106 |
| 3,547,828 | 12/1970 | Mansfield et al. | 252/351 |
| 3,598,865 | 8/1971 | Lew | 260/210 |
| 3,607,763 | 9/1971 | Salmen et al. | 252/528 |
| 3,640,998 | 2/1972 | Mansfield et al. | 260/210 |
| 3,644,203 | 2/1972 | Lamberti et al. | 252/8.75 |
| 3,671,644 | 6/1972 | Irani et al. | 424/346 |
| 3,703,480 | 11/1972 | Grand et al. | 252/524 |
| 3,721,633 | 3/1973 | Ranauto | 252/527 |
| 3,737,426 | 6/1973 | Throckmorton et al. | 260/210 |
| 3,772,269 | 11/1973 | Lew | 260/210 |
| 3,839,318 | 10/1974 | Mansfield | 260/210 |
| 3,862,045 | 1/1975 | Sato et al. | 252/8.75 |
| 3,892,669 | 7/1975 | Rapisarda et al. | 252/8.75 |
| 3,904,533 | 9/1975 | Neiditch | 252/8.8 |
| 3,951,879 | 4/1976 | Wixon | 252/547 |
| 3,959,157 | 5/1976 | Inamorato | 252/8.8 |
| 4,011,389 | 3/1977 | Langdon | 536/4 |
| 4,065,409 | 12/1977 | Flanagan | 252/528 |
| 4,140,641 | 2/1979 | Ramachandran | 252/8.75 |
| 4,154,706 | 5/1979 | Kenkare et al. | 252/547 |
| 4,187,121 | 2/1980 | Herald et al. | 134/26 |
| 4,222,905 | 9/1980 | Cockrell | 252/547 |
| 4,223,129 | 9/1980 | Roth et al. | 536/4 |
| 4,228,044 | 10/1980 | Cambre | 252/547 |
| 4,240,921 | 12/1980 | Kaniecki | 252/156 |
| 4,259,217 | 3/1981 | Murphy | 252/547 |
| 4,309,447 | 1/1982 | Tsutsumi et al. | 424/361 |

FOREIGN PATENT DOCUMENTS

| | | |
|---|---|---|
| 662710 | 10/1965 | Belgium . |
| 818419 | 7/1969 | Canada . |
| 593422 | 2/1934 | Fed. Rep. of Germany . |
| 3001064 | 7/1981 | Fed. Rep. of Germany . |
| 2342364 | 9/1977 | France . |
| 44126 | 11/1976 | Japan . |
| 135434 | 5/1977 | Japan . |
| 74098 | 6/1977 | Japan . |
| 2982 | 5/1976 | South Africa . |
| 830864 | 3/1960 | United Kingdom . |
| 873214 | 7/1961 | United Kingdom . |
| 1223911 | 3/1971 | United Kingdom . |

OTHER PUBLICATIONS

Schick, "Micelle Formation in Mixtures of Nonionic and Cationic Detergents", J. Amer. Oil Chemists Soc., 43 (12), 681 (1966).

Schmolka, "The Synergistic Effects of Nonionic Surfactants upon Cationic Germicidal Agents", J. Soc. Cosmet. Chem., 24, 577 (1973).

The Journal of The American Chemical Society, vol. 60, (Sep. 1938), pp. 2076–2077, Noller et al.

Nature, vol. 197 (Mar. 16, 1963), Schram et al.

Several data sheets, Rohm & Haas Co., Material Safety Data Sheet, Coded 6–1843; a page entitled "Manufacturing Specifications, Triton BG–10; A Specialty Chemicals Price List, schedule CS–429,25; a publication entitled The Qualitative and Quantitative Determination of Triton BG–10 in Bottle Washing Formulations. Coded CS–400.

The Journal of The American Oil Chemist's Society, vol. 47, #5, (May 1980), pp. 162–167, Hughes et al., "Physical and Functional Properties of Some Higher Alkyl Polyglucosides".

*Primary Examiner*—Dennis L. Albrecht

*Attorney, Agent, or Firm*—Donald E. Hasse; Robert B. Aylor; Thomas H. O'Flaherty

[57] ABSTRACT

Detergent compositions with a mixture of a conventional nonionic detergent surfactant, an alkylpolysaccharide detergent surfactant, and a cationic fabric-softening/antistatic compound deposit the cationic material more effectively than prior compositions containing only the conventional nonionic detergent surfactant and the cationic material.

9 Claims, No Drawings

LOW PHOSPHATE, SOFTENING LAUNDRY DETERGENT CONTAINING ETHOXYLATED NONIONIC, ALKYLPOLYSACCHARIDE AND CATIONIC SURFACTANTS

This is a continuation of application Ser. No. 376,877, filed on May 10, 1982 now abandoned.

TECHNICAL FIELD

This invention relates to laundry detergent compositions which exhibit surprisingly effective detergency as well as fabric softening and static control, even in the total absence of detergency builder materials. Specifically, completely unbuilt compositions of the present invention have demonstrated the ability to provide good detergency, fabric softening and static control. Other detergent compositions which utilize mixtures of selected nonionic surfactants and cationic surfactants are defined in U.S. Pat. Nos. 4,259,217 and 4,222,905, both of which are incorporated herein by reference.

The compositions of the present invention have excellent cleaning capabilities and are relatively insensitive to water hardness conditions, performing well in both hard and soft water conditions. Finally, in addition to this cleaning performance, the present invention provides, in a single detergent product, fabric softening and static control to the laundered fabrics.

SUMMARY OF THE INVENTION

The present invention relates to low- or no-phosphate laundry detergent compositions, especially beneficial for good cleaning and the effective provision of softening and antistatic benefits, having a pH in the laundry solution of greater than about 7, and, preferably, containing no more than about 15% phosphate, and no more than about 10% silicate materials, which comprise from about 5% to about 100%, by weight, of a surfactant mixture consisting essentially of:

(a) a nonionic surfactant, preferably one having the formula $R(OC_2H_4)_nOH$, wherein R is a primary alkyl chain containing an average of from about 10 to about 18 carbon atoms and n is an average of from about 2 to about 9, said nonionic surfactant having an HLB of from 5 to about 14, or a mixture of such surfactants;

(b) an alkylpolysaccharide detergent surfactant of the formula $RO(R'O)_y(Z)_x$ where R is an alkyl, hydroxyalkyl, alkylphenyl, hydroxyalkylphenyl, alkylbenzyl, or mixtures thereof, said alkyl groups containing from about 8 to about 18 carbon atoms; where each R' contains from 2 to about 4 carbon atoms and y is from 0 to about 12; and where each Z is a moiety derived from a reducing saccharide containing 5 or 6 carbon atoms, and x is a number from about $1\frac{1}{2}$ to about 10; and (c) a quaternary ammonium cationic surfactant having 2 chains which contain an average of from about 16 to about 22 carbon atoms, or a mixture of such surfactants;

the ratio of (a) to (b) being from about 7:1 to about 0:1, preferably from about 3:1 to about 1:3, and the rato of (a)+(b) to (c) being in the range of from about 2:1 to about 12:1, preferably from about 3:1 to about 9:1.

DISCLOSURE OF THE INVENTION

The compositions of the present invention comprise, by weight, from about 5 to about 100%, preferably from about 15 to about 90%, and most preferably from about 20 to about 80%, of a mixture of particularly defined nonionic, alkylpolysaccharide and cationic surfactants in the ratios stated herein. Preferred compositions contain at least about 15% of the nonionic/alkylpolysaccharide/cationic surfactant mixture and at least about $1\frac{1}{2}$ of the cationic component, itself, in order to assure the presence of a sufficient amount of both the cationic surfactant and the mixture to provide the desired cleaning and fabric conditioning benefits.

The compositions of the present invention contain the nonionic, alkylpolysaccharide and cationic surfactants, defined hereinafter, within ratios of nonionic and alkylpolysaccharide to cationic surfactant of from about 2:1 to about 12:1, preferably from about 3:1 to about 9:1 for cleaning; and most preferably from about 4:1 to about 9:1, in order to achieve the best soil removal performance.

In addition, using the mixtures of conventional nonionic detergent surfactants and polysaccharide detergent surfactants permits the use of considerably lower levels of the cationic surfactant to achieve a level of softening or antistatic effect that is achieved with a higher level of cationic surfactant when only the conventional nonionic detergent surfactant is used. In addition, there is no loss of cleaning when the polysaccharide detergent surfactant is used.

The compositions of the present invention are formulated so as to have a pH of at least about 7 in the laundry solution, at conventional usage concentrations, in order to optimize their overall cleaning performance, to aid in their manufacturing and processing, and to minimize the possibility of washing machine corrosion. Alkalinity sources, such as potassium hydroxide, potassium carbonate, potassium bicarbonate, sodium hydroxide, sodium carbonate and sodium bicarbonate, may be included in the compositions for this purpose. Some of the cationic/nonionic systems of the present invention may attain optimum removal of greasy/oily soils at higher pH's, while attaining optimum particulate soil removal at relatively lower pH's. In these systems, overall performance may be enhanced by varying the pH of the wash solution during the laundering process. Particularly preferred compositions have a pH of at least about 8 in the laundry solution, in order to optimize the removal of greasy/oily and body soils. In addition to the higher pH in the laundry solution, these preferred compositions should also have the ability to maintain a pH in the laundry solution of from about 8 to 11 throughout the washing operation (reserve alkalinity). Such a reserve alkalinity may be obtained by incorporating compounds which buffer at pH's of from about 8 to 11, such as monoethanolamine, diethanolamine or triethanolamine.

Preferred compositions of the present invention are also essentially free of oily hydrocarbon materials and solvents, such as mineral oil, paraffin oil and kerosene, since these materials, which are themselves oily by nature, load the washing liquor with excessive oily material, thereby diminishing the cleaning effectiveness of the compositions.

DESCRIPTION OF THE PREFERRED EMBODIMENTS

The Alkylpolysaccharide Surfactant

It has surprisingly been found that the nonionic cosurfactant interacts with the alkylpolysaccharide surfactant of this invention to provide good laundry detergency for a wide range of fabrics. The alkylpolysaccharides are those having a hydrophobic group containing from about 6 to about 30 carbon atoms, preferably from about 10 to about 16 carbon atoms and a polysaccharide, e.g., a polyglycoside, hydrophilic group containing from about $1\frac{1}{2}$ to about 10, preferably from about $1\frac{1}{2}$ to about 3, most preferably from about 1.6 to about 2.7 saccharide units. Any reducing saccharide containing 5 or 6 carbon atoms can be used, e.g. glucose, galactose and galactosyl moieties can substitute for the glucosyl moieties. (Optionally the hydrophobic group is attached at the 2, 3, 4 etc. positions thus giving a glucose or galactose as opposed to a glucoside or galactoside). The intersaccharide bonds can be, e.g., between the one position of the additional saccharide units and the 2-, 3-, 4-, and/or 6 positions on the preceding saccharide units.

Optionally, and less desirably, there can be a polyalkoxide chain joining the hydrophobic moiety and the polysaccharide moiety. The preferred alkoxide is ethylene oxide. Typical hydrophobic groups include alkyl groups, either saturated or unsaturated, branched or unbranched containing from about 8 to about 18, preferably from about 10 to about 16 carbon atoms. Preferably, the alkyl group is a straight chain saturated alkyl group. The alkyl group can contain up to 3 hydroxy groups and/or the polyalkoxide chain can contain up to about 10, preferably less than 5, most preferably 0, alkoxide moieties. Suitable alkyl polysaccharides are octyl, nonyl, decyl, undecyl, dodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses, and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which said alkyl groups conntain from about 10 to about 18, preferably from about 12 to about 14 carbon atoms; n is 2 or 3, preferably 2; t is from 0 to about 10, preferably 0; and x is from $1\frac{1}{2}$ to about 10, preferably from about $1\frac{1}{2}$ to about 3, most preferably from about 1.6 to about 2.7. The glycosyl is preferably derived from glucose. To prepare compounds the alcohol or alkylpolyethoxy alcohol is formed first and then reacted with glucose, or a source of glucose, to form the glucoside (attachment at the 1-position). The additional glycosyl units are attached between their 1-position and the preceding glycosyl units 2-, 3-, 4- and/or 6-position, preferably predominately the 2-position.

Preferably the content of alkylmonoglycoside is low, preferably less than about 60%, more preferably less than about 50%.

Nonionic Detergent Surfactant

Nonionic surfactants, including those having an HLB of from about 5 to about 17, are well known in the detergency art. They are included in the compositions of the present invention together with the, e.g., alkylpolyglycoside surfactants defined hereinbefore. They may be used singly or in combination with one or more of the preferred alcohol ethoxylate nonionic surfactants, described below, to form nonionic surfactant mixtures useful in combination with the alkylpolyglycosides. Examples of such surfactants are listed in U.S. Pat. No. 3,717,630, Booth, issued Feb. 20, 1973, and U.S. Pat. No. 3,332,880, Kessler et al, issued July 25, 1967, each of which is incorporated herein by reference. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

The conventional nonionic detergent surfactants which are preferred for use in the compositions of the present invention are biodegradable and have the formula $R(OC_2H_4)_nOH$, wherein R is a primary alkyl chain containing an average of from about 10 to about 18, preferably from about 10 to about 16, carbon atoms, and n is an average of from about 2 to about 9, preferably from about 2 to about 7. These nonionic surfactants have an HLB (hydrophilic-lipophilic balance) of from about 5 to about 14, preferably from about 6 to about 13. HLB, an indicator of a surfactant's hydrophilic or lipophilic nature, is defined in detail in *Nonionic Surfactants,* by M. J. Schick, Marcel Dekker, Inc., 1966, pages 607–613, incorporated herein by reference.

Preferred nonionic surfactants for use in the present invention include the condensation product of coconut alcohol with 5 moles of ethylene oxide; the condensation product of coconut alcohol with 6 moles of ethylene oxide; the condensation product of $C_{12-15}$ alcohol with 7 moles of ethylene oxide; the condensation product of $C_{12-15}$ alcohol with 9 moles of ethylene oxide; the condensation product of $C_{14-15}$ alcohol with 2.25 moles of ethylene oxide; the condensation product of $C_{14-15}$ alcohol with 7 moles of ethylene oxide; the condensation product of $C_{9-11}$ alcohol with 8 moles of ethylene oxide, which is stripped so as to remove unethoxylated and lower ethoxylate fractions; the condensation product of $C_{12-13}$ alcohol with 6.5 moles of ethylene oxide, and this same alcohol ethoxylate which is stripped so as to remove unethoxylated and lower ethoxylate fractions. A preferred class of such surfactants utilize alcohols which contain about 20% 2-methyl branched isomers, and are commercially available, under the tradename Neodol, from Shell Chemical Company. The condensation product of tallow alcohol with 9 moles of ethylene oxide is also a preferred nonionic surfactant for use herein. Particularly preferred nonionic surfactants for use in the compositions of the present invention include the condensation product of coconut alcohol with 5 moles of ethylene oxide, the condensation product of $C_{12-13}$ alcohol with 6.5 moles of ethylene oxide, the condensation product of $C_{12-15}$ alcohol with 7 moles of ethylene oxide, the condensation product of $C_{14-15}$ alcohol with 7 moles of ethylene oxide, and mixtures of those surfactants.

Other nonionic surfactants well known in the detergency art may be used, in combination with one or more of the required nonionic surfactants, to form useful nonionic surfactant mixtures. Examples of such surfactants are listed in U.S. Pat. No. 3,717,630, Booth, issued Feb. 20, 1973, and U.S. Pat. No. 3,332,880, Kessler et al, issued July 25, 1967, both of which are incorporated herein by reference. Nonlimiting examples of suitable nonionic surfactants which may be used in conjunction with the required nonionic surfactants, defined above, are: polyethylene oxide condensates of alkyl phenols, such as the Igepal surfactants, marketed by the GAF Corporation, and the Triton surfactants, marketed by the Rohm & Haas Company; condensation products of aliphatic alcohols with from about 10 to about 25 moles of ethylene oxide, where those alcohols are of a primary, branched or secondary alkyl chain structure; condensation products of ethylene oxide with a hydrophobic base formed by the condensation of propylene oxide with propylene glycol, such as Pluronic surfactants, marketed by Wyandotte Chemical Corporation; and condensation products of ethylene oxide with the product resulting from the reaction of propylene oxide and ethylene diamine, such as the Tetronic surfactants, marketed by Wyandotte Chemical Corporation.

Preferred compositions of the present invention are substantially free of fatty acid polyglycol ether di-ester compounds, such as polyethylene glycol-600-dioleate or polyethylene glycol-800-distearate. Such additive offer no advantage, and possibly even result in a disadvantage, in terms of achieving the particulate soil removal and fabric conditioning benefits provided by the present invention.

Cationic Component

The cationic surfactants used in the compositions of the present invention are of the di-long chain quaternary ammonium type, having two chains which contain an average of from about 16 to about 22, preferably from about 16 to about 18, carbon atoms. The remaining groups, if any, attached to the quaternary nitrogen atom, are preferably $C_1$ to $C_4$ alkyl or hydroxyalkyl groups. Although it is preferred that the long chains be alkyl groups, these chains can contain hydroxy groups or can contain heteroatoms or other linkages, such as double or triple carbon-carbon bonds, and ester, amide, or ether linkages, as long as each chain falls within the carbon atoms ranges required given above. Preferred cationic surfactants are those having the formulae

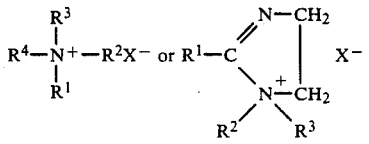

wherein the $R^1$ and $R^2$ groups contain an average of from about 16 to about 22 carbon atoms, preferably as alkyl groups, and most preferably contain an average of from about 16 to about 18 carbon atoms, $R^3$ and $R^4$ are $C_1$ to $C_4$ alkyl or hydroxyalkyl groups, and X is any compatible anion, particularly one selected from the group consisting of a halide (e.g., chloride), hydroxide, methylsulfate, or acetate anions.

Mixtures of the above surfactants are also useful in the present invention. These cationic surfactants can also be mixed with other types of cationic surfactants, such as sulfonium, phosphonium, and mono- or tri-long chain quaternary ammonium materials, as long as the amount of required cationic surfactant contained in the composition, falls with the nonionic:cationic ratio requirements specified herein.

Examples of cationic surfactants which can be used together with those required herein, include those described in U.S. Pat. No. 4,259,217, Murphy, U.S. Pat. No. 4,222,905, Cockrell, U.S. Pat. No. 4,260,529, Letton, and U.S. Pat. No. 4,228,042, Letton, which are incorporated herein by reference.

Preferred cationic surfactants include ditallowalkyldimethyl (or diethyl or dihydroxyethyl)ammonium chloride, ditallowalkyldimethylammonium methyl sulfate, dihexadecylalkyl ($C_{16}$) dimethyl (or diethyl, or dihydroxyethyl) ammonium chloride, dioctodecylalkyl ($C_{18}$)-dimethylammonium chloride, dieicosylalkyl- ($C_{20}$) dimethylammonium chloride, methyl (1) tallowalkyl amido ethyl (2) tallowalkyl imidazolinium methyl sulfate (commercially available as Varisoft 475 from Ashland Chemical Company), or mixtures of those surfactants. Particularly preferred cationic surfactants are ditallowalkyldimethylammonium methyl sulfate, methyl (1) tallowalkyl amido ethyl (2) tallowalkyl imidazolinium methyl sulfate, and mixtures of those surfactants, with ditallowalkyldimethylammonium chloride being especially preferred.

The compositions of the present invention can be formulated so as to be substantially free of ethoxylated cationic surfactants which contain more than an average of about 10, and preferably free of those which contain more than an average of about 7, moles of ethylene oxide per mole of surfactant. It is to be noted that polyethoxylated cationic surfactants having relatively low levels of ethoxylation, i.e., those with less than 10, and particularly less than 7, ethylene oxide groups exhibit better biodegradability characteristics.

In one embodiment of the present invention, the detergent compositions additionally contain from about 2 to about 25%, preferably from about 2 to about 16%, and most preferably from about 2 to about 10% of a fatty amide surfactant, such as ammonia amides (e.g., coconut ammonia amides), diethanol amides, and ethoxylated amides. In relation to the nonionic/cationic surfactant system, the ratio of the cationic/nonionic mixture to the amide component in the composition is in the range of from about 5:1 to about 50:1, preferably from about 8:1 to about 25:1. The use of amide in prior art compositions is described in greater detail in U.S. Pat. No. 4,228,044, Cambre, which is incorporated herein by reference. These amide components may also be added in small amounts, i.e., from about 2% to about 5%, to act as suds modifiers. Specifically, it is believed that they tend to boost the sudsing in an active system which exhibits relatively low sudsing, and depress the sudsing in an active system which exhibits relatively high sudsing.

The compositions of the present invention may also contain additional ingredients generally found in laundry detergent compositions, at their conventional art-established levels, as long as these ingredients are compatible with the nonionic and cationic components required herein. For example, the compositions can contain up to about 15%, preferably up to about 5%, and most preferably from about 0.001 to about 2%, of a suds suppressor component. Typical suds suppressors useful in the compositions of the present invention include, but are not limited to, silicone-type suds suppressing additives which are described in U.S. Pat. No. 3,933,672, issued Jan. 20, 1976, Bartolotta et al, incorporated herein by reference and the self-emulsifying silicone suds suppressors, described in U.S. Pat. No. 4,075,118, Gault et al, incorporated herein by reference. An example of such a compound is DB-544, commercially available from Dow Corning, which contains a siloxane/glycol copolymer together with solid silica and a siloxane resin.

Microcrystalline waxes having a melting point in the range from 35°-115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

Other adjunct components which can be included in the compositions of the present invention, in their conventional art-established levels for use (i.e., from about 0 to about 40%), include semi-polar nonionic (such as trialkyl amine oxides), zwitterionic and ampholytic detergency cosurfactants; detergency builders; bleaching agents; bleach activators; soil release agents; soil suspending agents; corrosion inhibitors; dyes; fillers; optical brighteners; germicides; pH adjusting agents; alkalinity sources; hydrotropes; enzymes; enzyme-stabilizing agents; perfumes; solvents; carriers; suds modifiers; opacifiers; and the like. However, because of the numerous and diverse performance advantages of the present invention, certain conventional components, such as detergent cosurfactants and detergency builders, as well as fabric softening and static control agents, will not generally be necessary in a particular formulation, giving the compositions of the present invention a potential cost advantage over conventional detergent/softener compositions. For environmental reasons the compositions of the present invention can contain less than about 15% phosphate materials. Preferred compositions contain less than 7% phosphate, and can even be substantially, or totally free of such phosphate materials, without excessively decreasing the performance of the compositions. The compositions of the present invention preferably contain less than 10%, and are preferably substantially free of, silicate materials. Preferred compositions of the present invention are also substantially free of carboxymethylcellulose. Finally, while the compositions of the present invention can contain very small amounts of anionic materials, such as hydrotropes (e.g., alkali metal toluene sulfonates), it is preferred that particular anionic materials be contained in amounts sufficiently small such that not more than about 10%, preferably not more than about 1%, of the cationic surfactant, contained in the laundry solution, is complexed by the anionic material. Such a complexing of the anionic material with the cationic surfactant, decreases the overall cleaning and fabric conditioning performance of the composition. Suitable anionic materials can be selected based on their strength of complexation with the cationic material included in the composition (as indicated by their dissociation constant). Thus, when an anionic material has a dissociation constant of at least about $1\times10^{-3}$ (such as sodium toluene sulfonate), it can be contained in an amount up to about 40%, by weight, of the cationic surfactant; and where the anionic material has a dissociation constant of at least about $1\times10^{-5}$, but less than about $1\times10^{-3}$, it can be contained in an amount up to about 15%, by weight, of the cationic surfactant. Preferred compositions are substantially or completely free of such anionic materials.

Examples of cosurfactants and detergency builders which can be used in the compositions of the present invention are found in U.S. Pat. No. 3,717,630, Booth, issued Feb. 20, 1973, and U.S. Pat. No. 4,259,217, Murphy, both of which are incorporated herein by reference. However, these components, particularly the anionic surfactants, should be checked with the particular nonionic/cationic surfactant system chosen, and used in an amount, so as to be certain that they will be compatible with the nonionic/cationic surfactant system.

The compositions of the present invention can be produced in a variety of forms, including liquid, solid, granular, paste, powder or substrate compositions. In a particularly preferred embodiment, the compositions of the present invention are formulated as liquids and contain up to about 20% of a lower alkyl ($C_1$ to $C_4$) alcohol, particularly ethanol. Liquid compositions containing lower levels of such alcohols (i.e., about 7 to 12%) tend to exhibit less phase separation than compositions containing higher alcohol levels.

The compositions of the present invention are used in the laundering process by forming an aqueous solution containing from about 0.01 (100 parts per million) to about 0.3% (3,000 parts per million), preferably from about 0.02 to about 0.2%, and most preferably from about 0.03 to about 0.15%, of the nonionic/cationic detergent mixture, and agitating the soiled fabrics in that solution. The fabrics are then rinsed and dried. When used in this manner, the compositions of the present invention yield exceptionally good particulate soil removal, and also provide fabric softening, static control, color fidelity, and dye transfer inhibition to the laundered fabrics, without requiring the use of any of the other conventionally-used fabric softening and/or static control laundry additives.

All percentages, parts, and ratios used herein are by weight unless otherwise specified.

The following nonlimiting examples illustrate the compositions and the method of the present invention.

EXAMPLE A

The following compositions illustrate the advantage in softening and antistatic performance for the invention as compared to conventional compositions containing only conventional nonionic detergent surfactants.

| | % by weight | | | | | | | | |
|---|---|---|---|---|---|---|---|---|---|
| Component | Base | A | B | C | D | E | F | G | H |
| Ditallow dimethyl ammonium chloride | 3.6 | 3.6 | 3.6 | 1.8 | 2.7 | 2.7 | 2.7 | 2.7 | 1.8 |
| Coconut alkyl dimethyl amine oxide | 4.0 | 4.0 | 4.0 | 4.0 | 2.0 | 2.0 | 2.0 | 2.0 | 4.0 |
| $C_{12-13}$ alkyl polyglycoside(~2)* | — | 9.0 | 18.0 | 9.0 | 20.0 | 14.0 | 10.0 | 6.0 | 9.0 |
| $C_{14-15}$ alkyl polyethoxylate(7)** | 18.0 | 9.0 | — | 9.0 | — | 6.0 | 10.0 | 19.0 | 9.0 |
| Ethanol | 7.5 | 7.5 | 7.5 | 7.5 | 7.5 | 7.5 | 7.5 | 7.5 | 7.5 |
| $H_2O$ and minors | Balance | | | | | | | | |

*The glycoside units are derived from glucose.
**The alcohol and monoethoxylated alcohol have been removed.

The static control readings were obtained as follows: A load of clothing was washed in a full size washing machine, using the composition given above at a usage concentration of about 1750 parts per million in 17½ gallons of 95° F. (35° C.) water, having a hardness of about 7 grains per gallon. The composition had a pH of about 8 in the laundry solution. The load consisted of about 33 pieces of clothing and contained cotton, polyester/cotton, nylon and polyester materials, and acrylic. The washed load was subsequently placed in an automatic dryer, the drum of which had been cleaned with an alcohol-soaked cloth, and dried for a period of 60 minutes. The fabric load was then removed from the dryer and placed in a grounded Faraday Cage. The overall charge reading of the materials in the Faraday Cage was read and recorded as individual items were removed from the Cage. When all the fabrics had been removed, the total voltage charge for the fabric load could be determined.

Softening is determined by grading with expert graders who used a grading scale of 0 to 4 in which 0 is equal; 1 is "I think this one is better."; 2 is "I know this one is a little better."; 3 is "This one is a lot better."; and 4 is "This one is a whole lot better." A difference of about ¾ is significant.

Cleaning was determined by grading standardly soiled and laundered swatches with expert graders using the standard grading scale previously described. A difference of about ¾ is significant as an average for all of the stained swatches.

The softening grades for A and B as compared to the base were 1.6 to 1.9 which are significant. C was compared to the base and was essentially equal in cleaning and static control, but was superior in softening. The grades were softening=1; cleaning (average)=0.1; and static control (total volts/clings)=52/2 for base and 42/0 for C. D, E. F, and G were tested against the base for softness and cleaning at the ½ cup level. The softening results vs. base were D=−0.2, E=−0.2, F=−0.2, and G=0 which are all nonsignificant. The cleaning averages were D=0.7, E=0.1, F=0, and G=1.0 of which only the last result is significant. The invention provides equal or better cleaning. With respect to static only, H is equivalent to the base with only one half of the static agent.

Similar results are obtained when the cationic sufactant in Composition A is replaced, in whole or in part, by ditallowalkyldimethylammonium methyl sulfate, ditallowalkyldimethylammonium iodide, dihexadecylalkyldimethylammonium chloride, dihexadecylalkyldihydroxylethylammonium methyl sulfate, dioctadecylalkyldimethylammonium chloride, dieicosylalkyl methyl ethyl ammonium chloride, dieicosylalkyl dimethylammonium bromide, methyl (1) tallowalkyl amido ethyl (2) tallowalkyl imidazolinium methyl sulfate, or mixtures of these surfactants.

Substantially similar results are also obtained where the nonionic surfactant in Composition A is replaced, in whole or in part, by the condensation product of $C_{14-15}$ alcohol with 2.25 moles of ethylene oxide; the condensation product of $C_{14-15}$ alcohol with 7 moles of ethylene oxide; the condensation product of $C_{12-15}$ alcohol with 9 moles of ethylene oxide; the condensation product of $C_{12-13}$ alcohol with 6.5 moles of ethylene oxide, which is stripped so as to remove lower ethoxylate and nonethoxylated fractions; the condensation product of coconut alcohol with 5 moles of ethylene oxide; the condensation product of coconut alcohol with 6 moles of ethylene oxide; the condensation product of $C_{12-15}$ alcohol with 7 moles of ethylene oxide; the condensation product of tallow alcohol with 9 moles of ethylene oxide; a 1:1 by weight mixture of the condensation product of $C_{12-15}$ alcohol with 7 moles of ethylene oxide and the condensation product of $C_{14-15}$ alcohol with 7 moles of ethylene oxide; and other mixtures of those surfactants.

Excellent results are also obtained where the ratio of nonionic surfactant to cationic surfactant used in Composition A is about 2:1, 3:1, 3.5:1, 4.5:1, 5:1, 6:1 or 8:1.

Excellent cleaning results are also obtained where the above composition additionally contains monoethanolamine, diethanolamine or triethanolamine, as an alkalinity source.

Similar performance is also obtained where the compositions contain a silicone suds suppressor selected from the group consisting of trimethyl-, diethyl-, dipropyl-, dibutyl-, methylethyl-, phenylmethyl polysiloxane, and mixtures thereof; a petrolatum or oxidized petrolatum wax; a Fischer-Tropsch or oxidized Fischer-Tropsch wax; ozokerite; ceresin; montan wax; beeswax; candelilla; or carnauba wax.

What is claimed is:

1. A low phosphate laundry detergent composition providing softening and/or antistatic benefits, having a pH in the laundry solution of greater than about 7, comprising from about 20% to about 80% by weight of a surfactant mixture consisting essentially of:

(a) an ethoxylated alcohol or alkylphenol nonionic detergent surfactant having an HLB of from 6 to about 14, or a mixture of such surfactants;

(b) an alkylpolysaccharide detergent surfactant of the formula $RO(C_2H_4O)_t$ $(glycosyl)_x$, where R is an alkyl containing from about 10 to about 18 caron atoms; t is from 0 to about 10; and x is a number from about $1\frac{1}{2}$ to about 3; and (c) a quaternary ammonium cationic surfactant having 2 chains which contain an average of from about 16 to about 22 carbon atoms, or a mixture of such surfactants; the weight ratio of (a) to (b) being from about 3:1 to about 1:3, and the weight ratio of (a)+(b) to (c) being in the range of from about 3:1 to about 9:1.

2. A composition according to claim 1 wherein the cationic surfactant is selected from the group consisting of

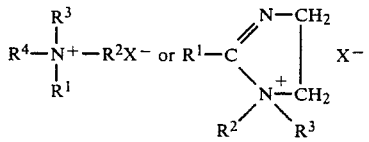

or mixtures thereof, wherein the $R^1$ and $R^2$ groups contain an average of from about 16 to about 22 carbon atoms, $R^3$ and $R^4$ are $C_1$ to $C_4$ alkyl or hydroxyalkyl groups, and X is an anion selected from the group consisting of halide, hydroxide, methyl sulfate, or acetate.

3. A composition according to claim 2 wherein $R^1$ and $R^2$ are alkyl groups.

4. A composition according to claim 3 wherein, the nonionic surfactant has the formula $R(OC_2H_4)_n$ OH wherein R is a primary alkyl chain containing an average of from about 10 to about 18 carbon atoms and n is an average of from about 2 to about 9.

5. A composition according to claim 4 wherein the nonionic surfactant is selected from the group consisting of the condensation product of $C_{14-15}$ alcohol with 2.25 moles of ethylene oxide; the condensation product of $C_{14-15}$ alcohol with 7 moles of ethylene oxide; the condensation product of $C_{12-15}$ alcohol with 7 moles of ethylene oxide; the condensation product of $C_{12-15}$ alcohol with 9 moles of ethylene oxide; the condensation product of $C_{12-13}$ alcohol with 6.5 moles of ethylene oxide, and the same product which is stripped so as to remove lower ethoxylate and nonethoxylated fractions; the condensation product of $C_{9-11}$ alcohol with 8 moles of ethylene oxide, which is stripped so as to remove lower ethoxylate and nonethoxylated fractions; the condensation product of coconut alcohol with 5 moles of ethylene oxide; the condensation product of coconut alcohol with 6 moles of ethylene oxide; the condensation product of tallow alcohol with 9 moles of ethylene oxide; and mixtures thereof.

6. A composition according to claim 5 wherein the cationic surfactant is selected from the group consisting of ditallowalkyldimethylammonium chloride, ditallowalkyldimethylammonium methyl sulfate, dihexadecylalkyldimethylammonium chloride, dioctadecylalkyldimethylammonium chloride, dieicosylalkyldimethylammonium chloride, methyl (1) tallowalkyl amido ethyl (2) tallowalkyl imidazolinium methyl sulfate, and mixtures thereof.

7. A composition according to claim 6 wherein the cationic surfactant is ditallowalkyldimethylammonium chloride.

8. a low phosphate laundry detergent composition, having a pH in the laundry solution of greater than about 7, comprising from about 20% to about 80% by weight of a surfactant mixture consisting essentially of:

(a) the condensation product of a $C_{14-15}$ alcohol with about 7 moles of ethylene oxide;

(b) an alkylpolyglycoside surfactant of the formula $R^2O(glycosyl)_x$, wherein $R^2$ is a $C_{12-13}$ alkyl group and x is about 2;

(c) ditallowalkyldimethylammonium chloride; wherein the weight ratio of (a) to (b) is from about 3:1 to 1:3, and the weight ratio of (a)+(b) to (c) is from about 3:1 to about 9:1.

9. A composition according to claim 8 comprising about 2.7% by weight of ditallowalkyldimethylammonium chloride and wherein the weight ratio of (a)+(b) to (c) is about 7.4.

* * * * *